US008061821B2

(12) United States Patent
Irie

(10) Patent No.: US 8,061,821 B2
(45) Date of Patent: Nov. 22, 2011

(54) LIQUID-DROPLET EJECTION HEAD AND INK JET PRINTER

(75) Inventor: Taiki Irie, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 413 days.

(21) Appl. No.: 12/412,460

(22) Filed: Mar. 27, 2009

(65) Prior Publication Data

US 2009/0256886 A1 Oct. 15, 2009

(30) Foreign Application Priority Data

Mar. 27, 2008 (JP) ..... 2008-084269

(51) Int. Cl.
*B41J 2/045* (2006.01)
*B41J 2/055* (2006.01)

(52) U.S. Cl. ..... 347/71; 347/92

(58) Field of Classification Search ..... 347/54, 347/68, 69, 70, 71, 84, 85, 92
See application file for complete search history.

(56) References Cited

U.S. PATENT DOCUMENTS 5,956,058 A 9/1999 Momose et al.
6,491,382 B2 12/2002 Taneya et al.
7,284,835 B2 10/2007 Watanabe
7,311,380 B2 * 12/2007 Watanabe et al. ..... 347/40
2002/0044177 A1 4/2002 Taneya et al.
2005/0036007 A1 2/2005 Watanabe
2007/0229609 A1 * 10/2007 Kim et al. ..... 347/84

FOREIGN PATENT DOCUMENTS

JP 7-178908 A 7/1995
JP 9-248914 A 9/1997
JP 2002-046271 A 2/2002
JP 2003-011357 A 1/2003
JP 2004-114477 A 4/2004
JP 2004-114520 A 4/2004
JP 2005-059439 A 3/2005
JP 2007-125808 A 5/2007

OTHER PUBLICATIONS

Machine-generated translation of Jp 2004-114477, published on Apr. 2004.*
JP Office Action dtd Apr. 27, 2010, JP Appln. 2008-084269, English translation.

* cited by examiner

*Primary Examiner* — Huan Tran
(74) *Attorney, Agent, or Firm* — Banner & Witcoff, Ltd

(57) ABSTRACT

A liquid-droplet ejection head may include stacked plates that form therein a common liquid channel and a plurality of individual ink channels extending from exits from the common liquid channel to nozzles via pressure chambers. At least one of the stacked plates may include an island-shaped partial plate surrounded by the common liquid channel and configured to form at least a part of side walls of the common liquid channel. The stacked plates may also include a support portion that transverse the common liquid channel and configured to support the partial plate. At least a part of a side edge of the support portion on an upstream side of a flow direction of liquid in the common liquid channel may be inclined to the flow direction, as viewed in a direction perpendicular to the stacked plates.

19 Claims, 9 Drawing Sheets

LIQUID-DROPLET EJECTION HEAD AND INK JET PRINTER

CROSS REFERENCE TO RELATED APPLICATION

This application claims priority to Japanese Patent Application No. 2008-084269, filed Mar. 27, 2008, the entire subject matter and disclosure of which is incorporated herein by reference.

BACKGROUND OF THE INVENTION

1. Field of the Invention

The invention relates to a liquid-droplet ejection head for ejecting liquid droplets onto the recording medium and an ink jet printer including the liquid-droplet ejection head.

2. Description of the Related Art

A known ink jet head for ejecting ink droplets includes a channel unit in which a common ink chamber and a plurality of individual ink channels are formed. The common ink chamber includes a plurality of manifold channels. The individual ink channels extend from exits from the manifold channels through pressure chambers to nozzles. The channel unit has a laminated structure in which a plurality of plates are stacked. Among these plates, manifold plates defining the side walls of the manifold channels include island-shaped partial plates surrounded by the manifold channels. The partial plates transverse the manifold channels and are supported by rectangular support portions connected to the opposite side walls of the manifold channels.

In the above-described ink jet head, bubbles flowing into the manifold channels stick to the side edges of the support portions and tend to stay in the manifold channels. Because the side edges of the support portions are perpendicular to a direction in which the manifold channels extend, i.e., a direction in which ink flows. As a result, a large amount of ink has to be discharged to discharge the bubbles outside, resulting in unnecessary consumption of ink.

SUMMARY OF THE INVENTION

A need has arisen for a liquid-droplet ejection head and an ink jet printer allowing efficiently discharging bubbles flowing into a common liquid channel.

According to one embodiment herein, a liquid-droplet ejection head may include stacked plates that form therein a common liquid channel and a plurality of individual ink channels extending from exits from the common liquid channel to nozzles via pressure chambers. At least one of the stacked plates may include an island-shaped partial plate surrounded by the common liquid channel and configured to form at least a part of side walls of the common liquid channel. The stacked plates may also include a support portion that transverse the common liquid channel and configured to support the partial plate. At least a part of a side edge of the support portion on an upstream side of a flow direction of liquid in the common liquid channel may be inclined to the flow direction, as viewed in a direction perpendicular to the stacked plates.

According to another embodiment herein, an ink jet printer may include a liquid-droplet ejection head including stacked plates that form therein a common liquid channel and a plurality of individual ink channels extending from exits from the common liquid channel to nozzles via pressure chambers. The ink jet printer may also include a sheet feeding device configured to feed a recording medium. The ink jet printer may further include a sheet discharge device configured to discharge the recording medium. The ink jet printer may yet further include a sheet conveying path extending from the sheet feeding device to the sheet discharge device along which the recording medium is conveyed. At least one of the stacked plates may include an island-shaped partial plate surrounded by the common liquid channel and configured to form at least a part of side walls of the common liquid channel. The stacked plates may also include a support portion that transverse the common liquid channel and configured to support the partial plate. At least a part of a side edge of the support portion on an upstream side of a flow direction of liquid in the common liquid channel may be inclined to the flow direction, as viewed in a direction perpendicular to the stacked plates.

Other objects, features and advantages will be apparent to those skilled in the art from the following detailed description and accompanying drawings.

DESCRIPTION OF THE EMBODIMENTS

Embodiments are described with reference to the accompanying drawings, which are given by way of example only, and are not intended to limit the present invention.

Figure 1:
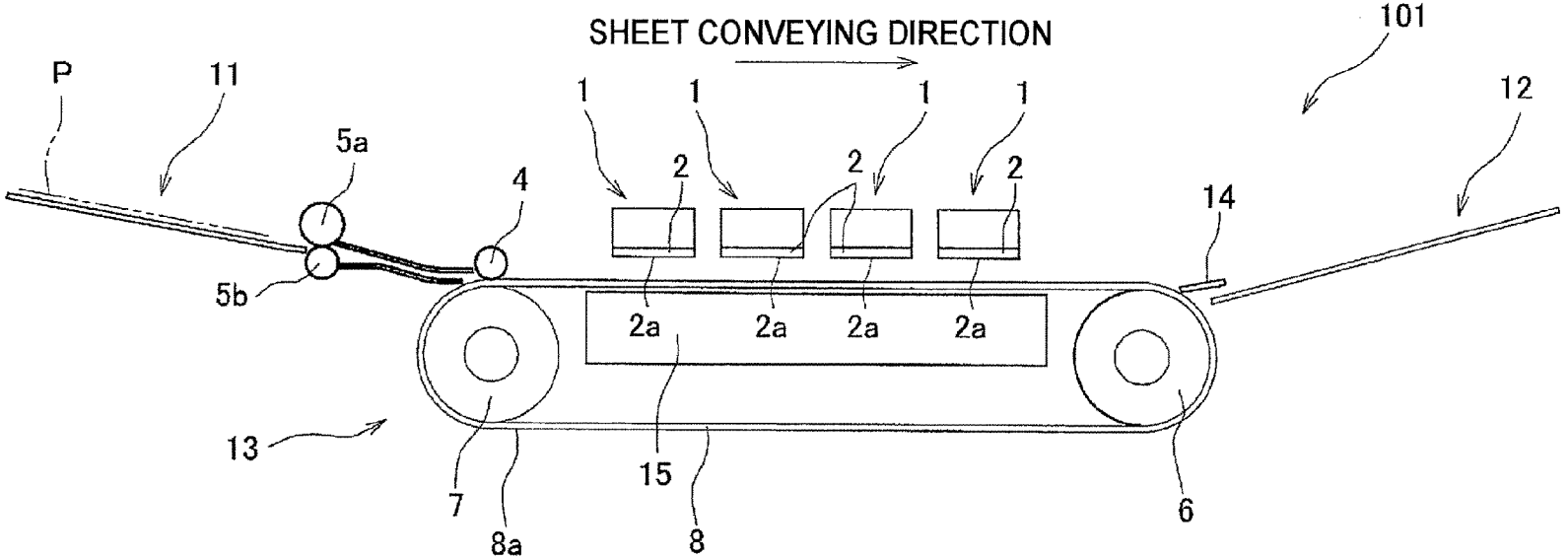
FIG. 1 is an external side view of an ink jet printer including an ink jet head according to an embodiment.

Referring to FIG. 1, an ink jet printer 101 may be a color ink jet printer including a plurality of, e.g., four, ink jet heads 1. The ink jet printer 101 may include a sheet feeding device 11 on the left side and a sheet discharge device 12 on the right side in FIG. 1.

A sheet conveying path extending from the sheet feeding device 11 to the sheet discharge device 12, along which a sheet P is conveyed, may be formed in the inkjet printer 101. A pair of feed rollers 5*a* and 5*b*, which nip and convey sheet P, may be positioned immediately on the downstream side of the sheet feeding device 11. The feed rollers 5*a* and 5*b* may feed the sheet P from the sheet feeding device 11 toward the right side in FIG. 1. A conveying mechanism 13 may be disposed in the middle of the sheet conveying path. The conveying mechanism 13 may include a plurality of, e.g., two, belt rollers 6 and 7, an endless conveying belt 8 that runs around the rollers 6 and 7, and a platen 15 disposed in a region surrounded by the conveying belt 8. The platen 15 may support the conveying belt 8 to prevent the conveying belt 8 from sagging downward, at a position opposing the inkjet heads 1. A nip roller 4 may be disposed at a position opposing the belt roller 7. The nip roller 4 may press the sheet P fed from the sheet feeding device 11 by the feed rollers 5*a* and 5*b* onto an outer circumference 8*a* of the conveying belt 8.

When a conveying motor (not shown) rotates the belt roller 6, the conveying belt 8 may run. Thus, the conveying belt 8 may convey the sheet P pressed onto the outer circumference 8*a* by the nip roller 4 to the sheet discharge device 12, while holding the sheet P by adhesion. The conveying belt 8 may include a weak-adhesive silicon resin layer on the surface.

A separating plate 14 may be disposed immediately on the downstream side of the conveying belt 8. The separating plate 14 may separate the sheet P adhered to the outer circumference 8*a* of the conveying belt 8 from the outer circumference 8*a*. The separating plate 14 may also guide the sheet P to the sheet discharge device 12 shown on the right side in FIG. 1.

The plurality of, e.g., four, ink jet heads 1 may correspond to ink of a plurality of, e.g., four, colors, namely, magenta, yellow, cyan, and black, and may be arranged in a conveying direction. The inkjet heads 1 each may have a head body 2 at the lower end. The head bodies 2 may have a rectangular-parallelepiped shape elongated in a direction perpendicular to the conveying direction. The bottom surfaces of the head bodies 2 may be ink ejection surfaces 2*a* opposing the outer circumference 8*a* of the conveying belt 8. When the sheet P conveyed by the conveying belt 8 sequentially passes immediately below the head bodies 2, ink droplets of respective colors may be ejected from the ink ejection surfaces 2*a* onto the upper surface, i.e., print surface, of the sheet P. Thus, a desired color image may be formed on the print surface of the sheet P.

Figure 2:
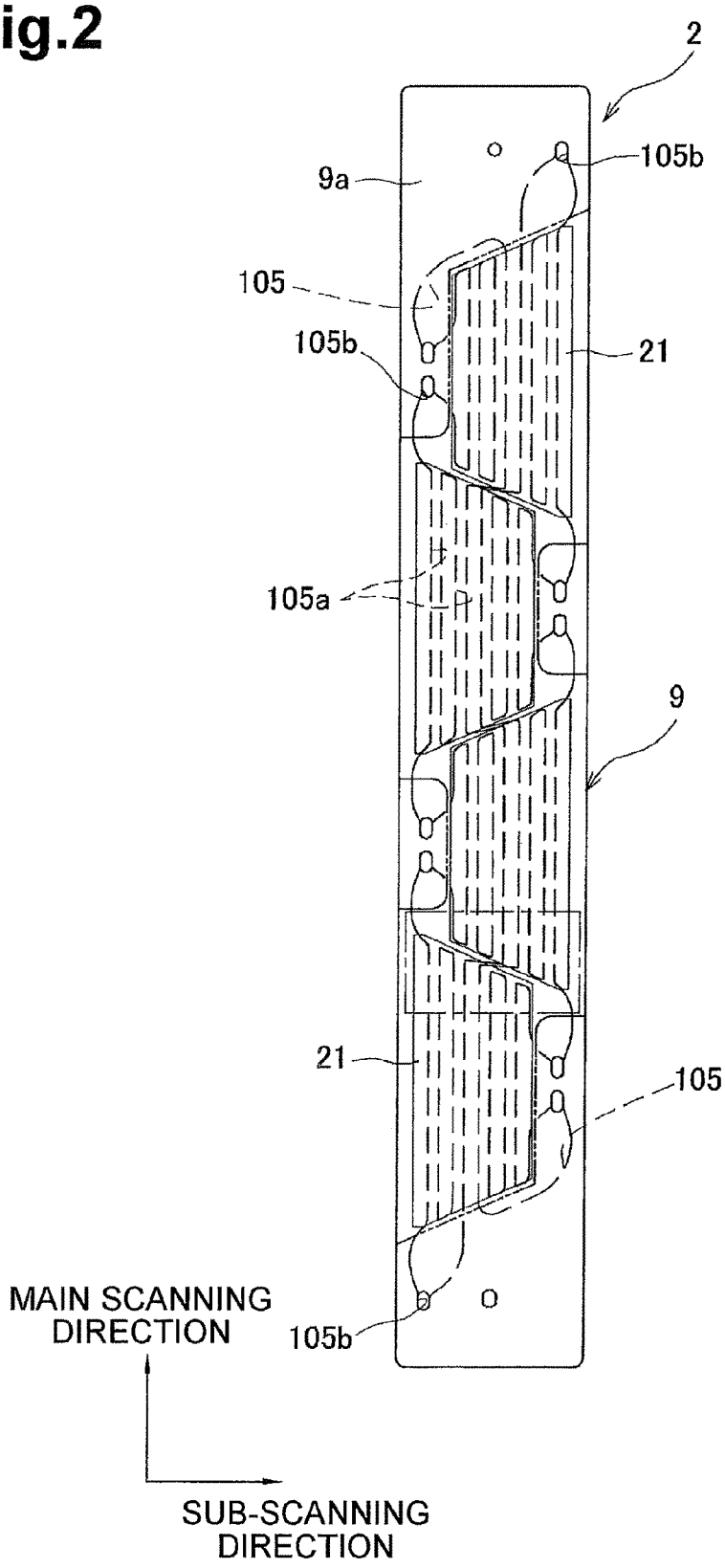
FIG. 2 is a plan view of a head body.

Referring to FIG. 2, each head body 2 may constitute the ink jet head 1, after being assembled with a reservoir unit (not shown) for storing ink from an ink tank (not shown) and supplying the ink to a channel unit 9 and a driver IC (not shown) for generating a driving signal for driving the actuator units 21. In the head body 2, a plurality of, e.g., four, actuator units 21 may be fixed to an upper surface 9*a* of the channel unit 9.

Figure 3:
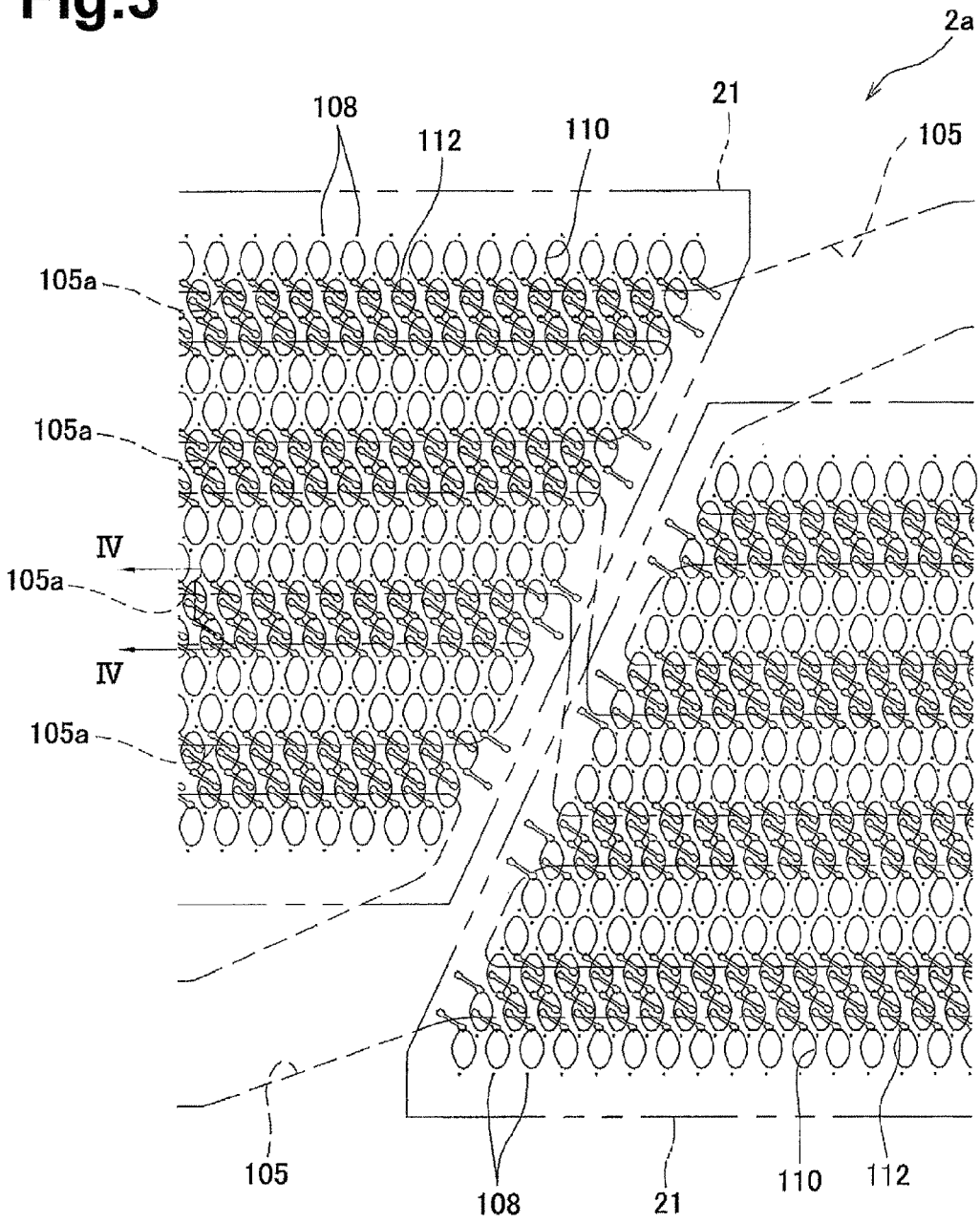
FIG. 3 is an enlarged view of a region enclosed by an alternate long and short dash line shown in FIG. 2.

Referring to FIG. 3, the channel unit 9 may include ink channels including manifold channels 105, the pressure chambers 110, and the like. The actuator units 21 may include a plurality of actuators corresponding to the pressure chambers 110 and may selectively apply ejection energy to the ink in the pressure chambers 110 when driven by the driver IC. In FIG. 3, for convenience of explanation, pressure chambers 110, apertures 112, and nozzles 108 that are below actuator units 21 are illustrated by a solid line.

Each channel unit 9 may have a rectangular-parallelepiped-shape. The upper surface 9*a* of the channel unit 9 may have a plurality of, e.g., ten, ink supply ports 105*b* corresponding to ink discharge ports (not shown) of the reservoir unit. The channel unit 9 may include a plurality of, e.g., two, manifold channels 105, each communicating with a plurality of, e.g., five, ink supply ports 105*b* arranged in the longitudinal direction (i.e., main scanning direction) of the channel unit 9, at positions near edges of the channel unit 9 in the transverse direction (i.e., sub-scanning direction). Each manifold channel 105 may include a plurality of sub-manifold channels 105*a* that branch off therefrom and extend parallel to each other in the main scanning direction. The sub-manifold channels 105*a* may communicate with one another at both ends, and ink may flow therein from both ends in the direction in which the sub-manifold channels 105*a* extend. Thus, ink may flow in either direction in the sub-manifold channels 105*a*.

The ink ejection surface 2*a* including a plurality of the nozzles 108 arranged in a matrix may be formed at the lower surface of the channel unit 9. Similarly to the nozzles 108, a plurality of the pressure chambers 110 may be arranged in a matrix in a surface of the channel unit 9 to which the actuator units 21 are fixed.

A plurality of, e.g., sixteen, rows of the pressure chambers 110 that are arranged in the longitudinal direction of the channel unit 9 at equal distances apart from one another may be arranged parallel to one another in the transverse direction. The actuator units 21 may have a trapezoidal shape. Thus, the number of the pressure chambers 110 in each pressure chamber row may be gradually reduced from the long-side end to the short-side end of the actuator units 21 so as to conform to their shape. The nozzles 108 may be also arranged in this manner.

Figure 4:
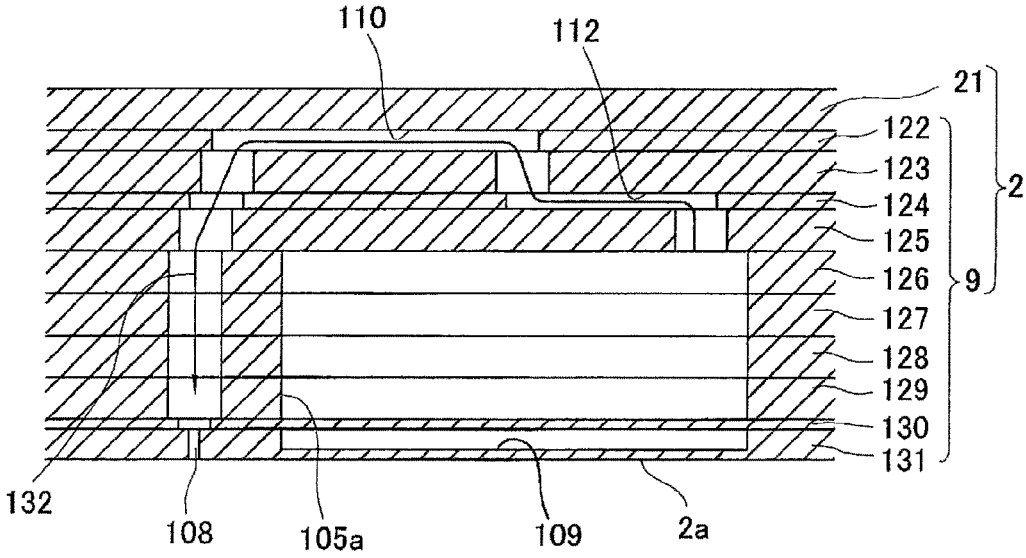
FIG. 4 is a sectional view taken along line IV-IV in FIG. 3.

Referring to FIG. 4, the channel unit 9 may include a damper chamber 109 corresponding to each sub-manifold channel 105*a*. The damper chamber 109 may be a space formed between a damper plate 130 and a nozzle plate 131. The damper chamber 109 may be defined by the lower surface of the damper plate 130 and a recess formed in the upper surface of the nozzle plate 131. The nozzle plate 131 may also include the nozzles 108 through which the ink droplets are ejected. The damper plate 130 may function as the bottom of the sub-manifold channel 105*a*. Elastic deformation of the damper plate 130 in the damper chamber 109 may minimize pressure fluctuations in the sub-manifold channel 105*a*.

Each channel unit 9 may be composed of a plurality of, e.g., ten, plates 122 to 131 made of metal such as stainless steel. These plates 122 to 131, including a supply plate 125, manifold plates 126 to 129, the damper plate 130, and the nozzle plate 131, may be rectangular flat plates elongated in the main scanning direction.

By aligning and stacking these plates 122 to 131, through holes formed in the plates 122 to 131 may be connected. Thus, a plurality of, e.g., two, manifold channels 105, multiple individual ink channels 132 extending from supply ports 125*a*, functioning as the exits from the sub-manifold channels 105*a* of each manifold channel 105, through the pressure chambers 110 to the nozzles 108, and the damper chambers 109 may be formed in the channel unit 9.

Ink supplied from the reservoir unit through the ink supply ports 105*b* to the channel unit 9 may flow from the manifold channels 105 to the sub-manifold channels 105*a*. The ink in the sub-manifold channels 105*a* may flow into the individual ink channels 132, may pass through the apertures 112, functioning as throttles, and the pressure chambers 110, and may reach the nozzles 108.

Referring to FIG. 4, the manifold channels 105 may be formed by stacking, in sequence from top to bottom, the supply plate 125, the plurality of, e.g., four, manifold plates 126 to 129, and the damper plate 130. The supply plate 125 may function as the ceiling of the manifold channels 105 and may include the supply ports 152*a* each functioning as an end of the individual ink channel 132. The manifold plates 126 to 129 may define the side walls of the manifold channels 105. The damper plate 130 may function as the bottom of the manifold channels 105.

Figure 5:
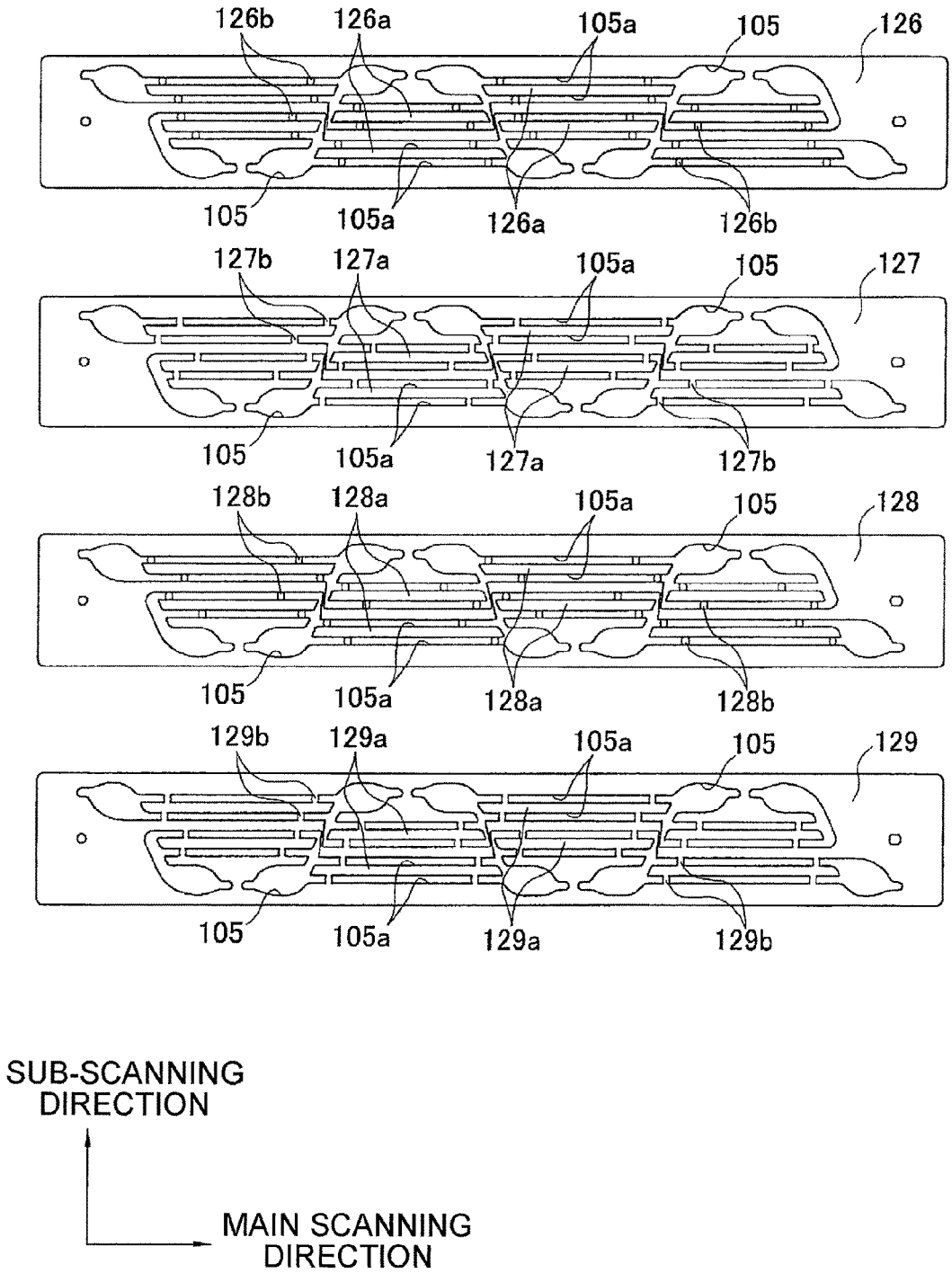
FIG. 5 is a plan view of a plurality of manifold plates constituting side walls of manifold channels.

Referring to FIG. 5, the manifold plates 126, 127, 128, and 129 may include a plurality of island-shaped partial plates 126*a*, 127*a*, 128*a*, and 129*a*, respectively. The island-shaped partial plates 126*a*, 127*a*, 128*a*, and 129*a* may be surrounded by the manifold channels 105 (i.e., sub-manifold channels 105*a*) and may extend in one direction (i.e. a direction in which the sub-manifold channels 105*a* extend). Thus, the edges of the partial plates 126*a*, 127*a*, 128*a*, 129*a* may constitute the walls of the sub-manifold channels 105*a*. The manifold plates 126, 127, 128, and 129 may include support portions 126*b*, 127*b*, 128*b*, and 129*b*, respectively. The support portions 126*b*, 127*b*, 128*b*, and 129*b* may transverse the sub-manifold channels 105*a* and may support the partial plates 126*a*, 127*a*, 128*a*, and 129*a*. More specifically, the support portions 126*b*, 127*b*, 128*b*, and 129*b* may be disposed at positions that are close to both ends of each of the partial plates 126*a*, 127*a*, 128*a*, and 129*a* in the direction in which the sub-manifold channels 105*a* extend. Further, the support portions 126*b*, 127*b*, 128*b*, and 129*b* may be disposed on both sides of each of the partial plates 126*a*, 127*a*, 128*a*, and 129*a* with respect to the direction in which the partial plates 126*a*, 127*a*, 128*a*, and 129*a* extend.

Figure 6:
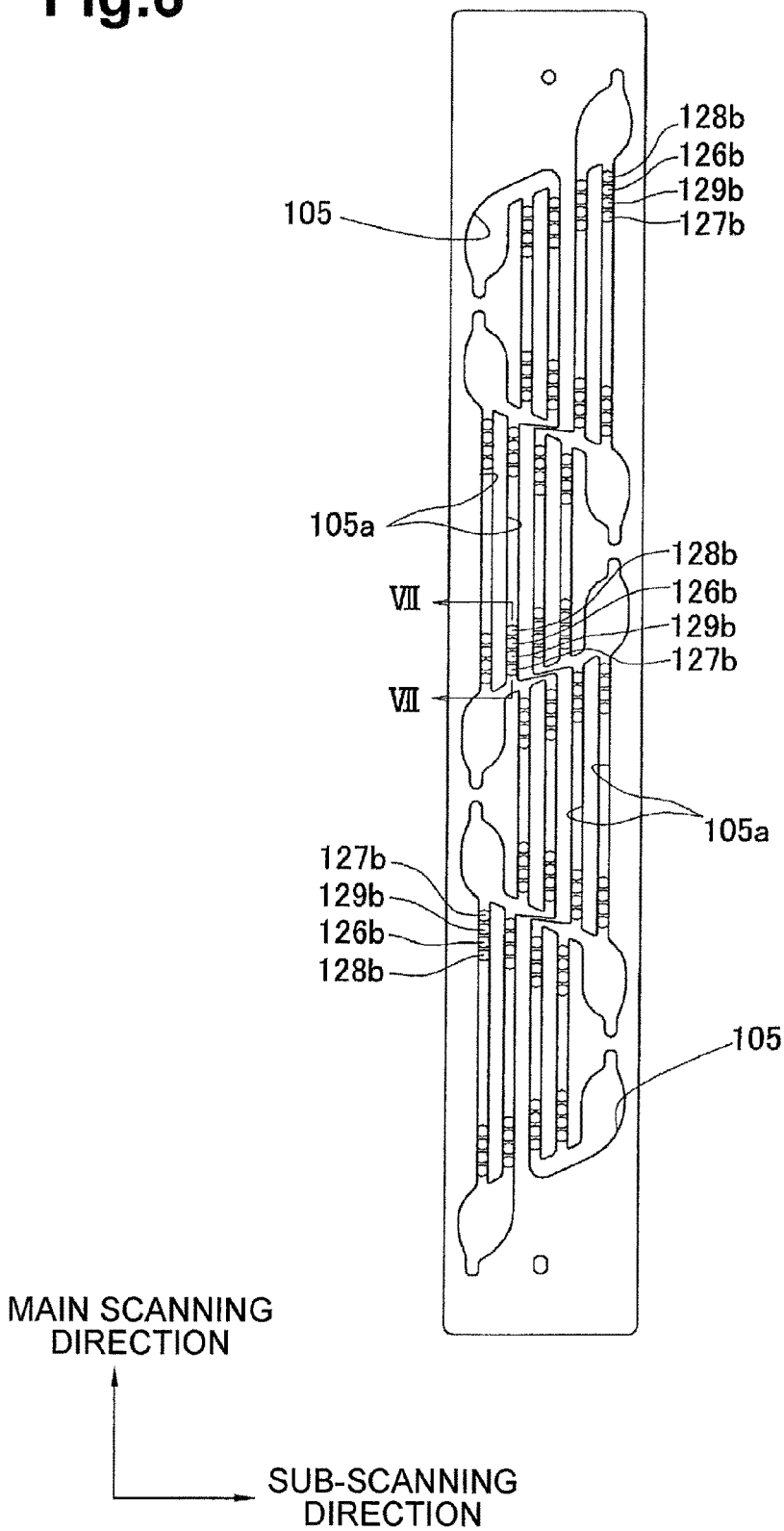
FIG. 6 is a plan view of the manifold channels.
Figure 7:
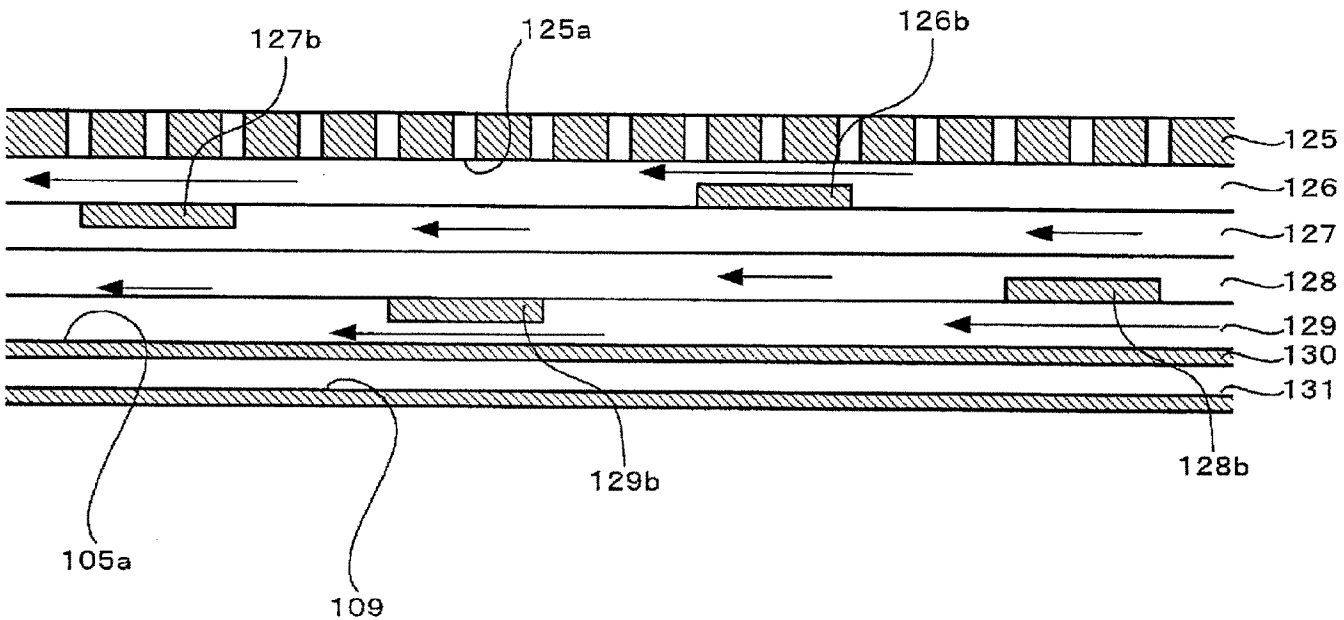
FIG. 7 is a sectional view taken along line VII-VII in FIG. 6.

Referring to FIGS. 6 and 7, the upper surfaces (i.e., the surfaces adjacent to the supply plate 125) of the support portions 126*b*, the lower surfaces (i.e., the surfaces adjacent to the damper plate 130) of the support portions 127*b*, the upper surfaces of the support portions 128*b*, and the lower surfaces of the support portions 129*b* may be formed by half-etching. Therefore, the upper surfaces of the support portions 126*b* may be below those of the partial plates 126*a*. The lower surfaces of the support portions 127*b* may be above those of the partial plates 127*a*. The upper surfaces of the support portions 128*b* may be below those of the partial plates 128*a*. The lower surfaces of the support portions 129*b* may be above those of the partial plates 129*a*. The thickness of the support portions 126*b*, 127*b*, 128*b*, and 129*b* may be about half that of the partial plates 126*a*, 127*a*, 128*a*, and 129*a*, allowing ink and bubbles to smoothly flow in the sub-manifold channels 105*a*.

Because the upper surfaces of the support portions 126*b* are separated from the lower surface of the supply plate 125, the support portions 126*b* may not block ink flowing from the sub-manifold channels 105*a* through the supply ports 125*a* formed in the supply plate 125 to the individual ink channels 132. Thus, the ink and bubbles in the sub-manifold channels 105*a* may efficiently flow into the individual ink channels 132. Furthermore, because the lower surfaces of the support portions 129*b* are separated from the upper surface of the damper plate 130, the support portions 129*b* may not block the movement of the damper plate 130. Thus, the damper chambers 109 may efficiently minimize the pressure fluctuations in the sub-manifold channels 105*a*.

The support portions 127*b* and 128*b* may be disposed in the manifold plates 127 and 128, which are positioned in the middle of the sub-manifold channel 105*a* in the stacking direction. The surfaces of the support portions 127*b* opposing the middle of the sub-manifold channels 105*a* may be farther than that of the manifold plate 127 from the middle of the sub-manifold channels 105*a*. Similarly, the surfaces of the support portions 128*b* opposing the middle of the sub-manifold channels 105*a* may be farther than that of the manifold plate 128 from the middle of the sub-manifold channels 105*a*. This structure may increase the difference between the ink-flow rates on both sides of each of the support portions 127*b* and 128*b* in the stacking direction. Therefore, the bubbles that stick to the support portions 127*b* and 128*b* may easily flow with the ink flowing at a high rate and may not stay in the sub-manifold channels 105*a*.

A plurality of, e.g., four, support portions 126*b*, 127*b*, 128*b*, and 129*b* may be disposed at a predetermined distance from one another in the direction in which the sub-manifold channels 105*a* extend, near each end of the sub-manifold channels 105*a* in the extending direction thereof. Because the adjacent support portions 126*b*, 127*b*, 128*b*, and 129*b* are separated from one another in the ink-flow direction, bubbles may be prevented from staying between the adjacent support portions 126*b*, 127*b*, 128*b*, and 129*b*.

Each of the manifold plates 126, 127, 128, and 129, including the support portions 126*b*, 127*b*, 128*b*, and 129*b*, and the manifold plate 126, 127, 128, and 129, including the support portions 126*b*, 127*b*, 128*b*, and 129*b*, that are adjacent to the aforementioned support portions 126*b*, 127*b*, 128*b*, 129*b* in the direction in which the sub-manifold channels 105*a* extend may be stacked with one or two manifold plates interposed therebetween. In other words, one or two manifold plates may be disposed between the manifold plates including the support portions 126*b*, 127*b*, 128*b*, and 129*b* adjacent to each other in the extending direction of the channels. Accordingly, regardless of the distance between the support portions 126*b*, 127*b*, 128*b*, and 129*b* in the extending direction, bubbles may be less likely to stay between the adjacent support portions 126*b*, 127*b*, 128*b*, and 129*b*.

Referring to FIG. 7, in sequence from the right side, the support portions 128*b*, 126*b*, 129*b*, and 127*b* may be disposed in the direction in which the sub-manifold channels 105*a* extend. One manifold plate, namely, the manifold plate 127 may be disposed between the manifold plate 128 including the support portions 128*b* and the manifold plate 126 including the support portions 126*b*. Similarly, two manifold plates, namely, the manifold plates 127 and 128 may be disposed between the manifold plate 126 including the support portions 126*b* and the manifold plate 129 including the support portions 129*b*. Similarly, one manifold plate, namely, the manifold plate 128 may be disposed between the manifold plate 129 including the support portions 129*b* and the manifold plate 127 including the support portions 127*b*.

Thus, the distance, in the stacking direction, between the support portions adjacent to one another in the direction in which the sub-manifold channels 105*a* extend may be larger than the thickness of the manifold plates. This may prevent bubbles from staying between the adjacent support portions 126*b*, 127*b*, 128*b*, and 129*b* and may enable the bubbles flowing into the sub-manifold channels 105*a* to be efficiently discharged.

The plurality of, e.g., four, support portions 126*b*, 127*b*, 128*b*, and 129*b* may be disposed in the direction in which the sub-manifold channels 105*a* extend, alternately on the supply plate 125 side and the damper plate 130 side with respect to the middle of the sub-manifold channels 105*a* in the stacking direction. In other words, in the support portions 126*b*, 127*b*, 128*b*, and 129*b*, the relationship between the distances, in the stacking direction, between the ceiling of the sub-manifold channel 105*a* and the surface of the support portions 126*b*, 127*b*, 128*b*, and 129*b* opposing the ceiling and between the bottom of the sub-manifold channel 105*a* and the surface of the support portions 126*b*, 127*b*, 128*b*, and 129*b* opposing the bottom may be different from that in the adjacent support portions 126*b*, 127*b*, 128*b*, and 129*b*.

The closer to the ceiling or bottom of the sub-manifold channel 105*a* the support portions 126*b*, 127*b*, 128*b*, and 129*b* may be positioned, the higher the flow rate of ink passing therebetween. Thus, the relationship between the ink-flow rates on both sides of the support portion 126*b*, 127*b*, 128*b*, and 129*b*, in the stacking direction, may be opposite to that of the support portions 126*b*, 127*b*, 128*b*, and 129*b* adjacent to the aforementioned support portions 126*b*, 127*b*, 128*b*, and 129*b* in the direction in which the sub-manifold channels 105*a* extend. As a result, bubbles may change the rotation direction each time they pass the support portions 126*b*, 127*b*, 128*b*, and 129*b*. Accordingly, bubbles may be further prevented from staying between the adjacent support portions 126*b*, 127*b*, 128*b*, and 129*b*.

Figure 8:
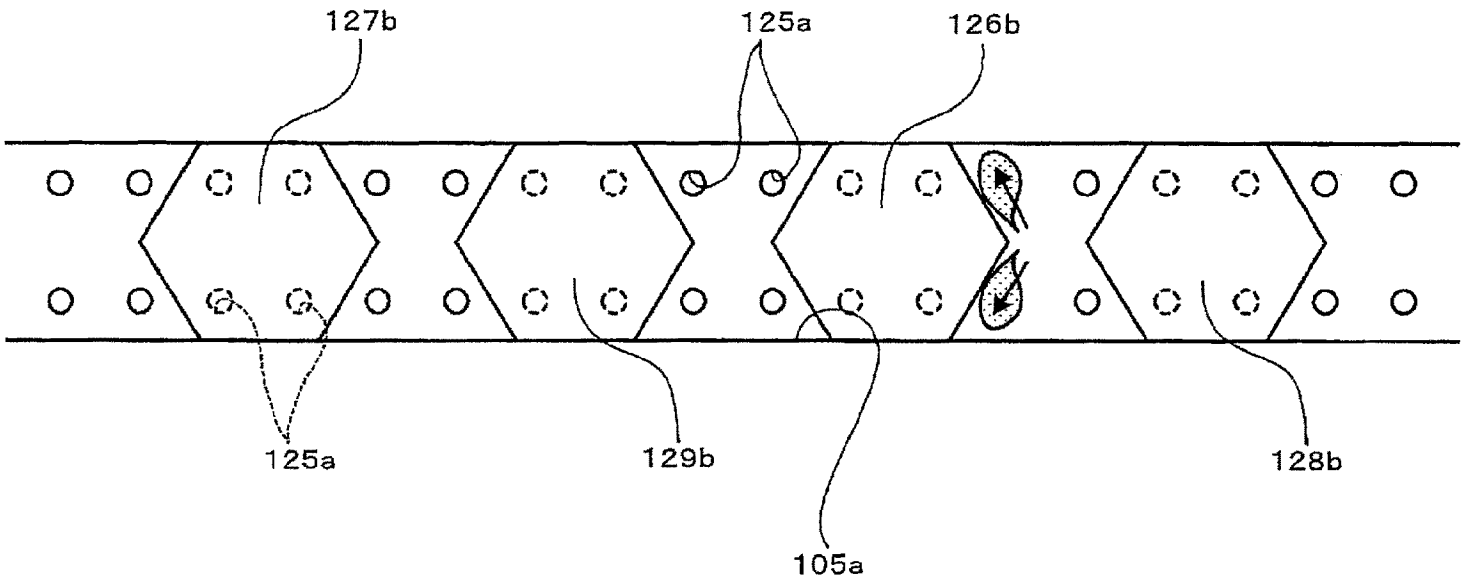
FIG. 8 is a bottom view of a sub-manifold channel.

Referring to FIG. 8, the supply ports 125*a* may be formed in the ceiling of each sub-manifold channel 105*a*, near both edges in the width direction of the sub-manifold channel 105*a* (herein after referred to as "width direction"). The supply ports 125*a* may be arranged in a plurality of, e.g., two, rows in the direction in which the sub-manifold channel 105*a* extends (herein after referred to as "extending direction").

Side edges of each of the support portions 126*b*, 127*b*, 128*b*, and 129*b* transverse the extending direction, as viewed in the stacking direction (i.e., the direction perpendicular to the surfaces of the manifold plates 126 to 129), may be inclined toward the center of the support portion 126*b*, 127*b*, 128*b*, and 129*b* in the extending direction, from the middle in the width direction to the side walls of the sub-manifold channel 105*a*. At least one of the side edges of each of the support portions 126*b*, 127*b*, 128*b*, and 129*b* may be inclined toward the downstream side of the ink-flow direction. Thus, the side edges of each of the support portions 126*b*, 127*b*, 128*b*, and 129*b* may project in the extending direction, in the middle in the width direction. In this embodiment, as viewed in the stacking direction, each support portions 126*b*, 127*b*, 128*b*, and 129*b* may have a line-symmetrical shape with respect to an imaginary line extending in the width direction.

As has been described, the supply ports 125*a* may be arranged near both edges in the width direction, and the apexes of the side edges of the support portions 126*b*, 127*b*, 128*b*, and 129*b* may be arranged in the middle in the width direction. In other words, the apexes of the side edges of the support portions 126*b*, 127*b*, 128*b*, and 129*b* may be arranged so as to oppose a region where the supply ports 125*a* are not arranged. The side edges of the support portions 126*b*, 127*b*, 128*b*, and 129*b* may be inclined to the ink-flow direction, as viewed in the stacking direction.

For example, when ink flows in the sub-manifold channel 105*a* from the right side to the left side in FIG. 8, the bubbles flowing into the sub-manifold channel 105*a* may collide with the apexes of the side edges of the support portions 126*b*, 127*b*, 128*b*, and 129*b* and may break into small bubbles (in FIG. 8, the bubble collides with the support portion 126*b*). Then, the small bubbles may move along the inclined side edges of the support portions 126*b*, 127*b*, 128*b*, and 129*b*, from the middle in the width direction to the side walls of the sub-manifold channel 105*a* (see the arrows). Thus, the small bubbles may move in the ink-flow direction so as to be guided to the supply ports 125*a*, which also function as ink discharge ports.

According to this embodiment, because the side edges of the support portions 126*b*, 127*b*, 128*b*, and 129*b* are inclined to the ink-flow direction, the bubbles flowing into the sub-manifold channel 105*a* may easily move in the flow direction along the inclined side edges of the support portions 126*b*, 127*b*, 128*b*, and 129*b*. Because this prevents the bubbles flowing into the sub-manifold channels 105*a* from sticking to and staying at the support portions 126*b*, 127*b*, 128*b*, and 129*b*, the bubbles may be efficiently discharged.

Furthermore, because the side edges of the support portions 126*b*, 127*b*, 128*b*, and 129*b* project outward in the extending direction in the middle in the width direction, the bubbles flowing into the sub-manifold channels 105*a* may collide with the apexes of the side edges of the support portions 126*b*, 127*b*, 128*b*, and 129*b* and may break into small bubbles. Thus, the bubbles flowing into the sub-manifold channels 105*a* may be further efficiently discharged.

The supply ports 125*a* may be arranged near both edges in the width direction, and the side edges of each of the support portions 126*b*, 127*b*, 128*b*, and 129*b* transverse the extending direction, as viewed in the stacking direction, may be inclined from the middle in the width direction toward the downstream side of the ink-flow direction. Therefore, the bubbles broken into small bubbles by the apexes of the side edges of the support portions 126*b*, 127*b*, 128*b*, and 129*b* may flow in the ink-flow direction so as to be guided to the supply ports 125*a*. Thus, the bubbles flowing into the sub-manifold channel 105*a* may be further efficiently discharged.

Furthermore, because the support portions 126*b*, 127*b*, 128*b*, and 129*b* are each line-symmetrical with respect to an imaginary line extending in the width direction as viewed in the stacking direction, the bubbles flowing into the sub-manifold channels 105*a* from both ends may be efficiently discharged.

MODIFICATION EXAMPLES

Figure 9A:
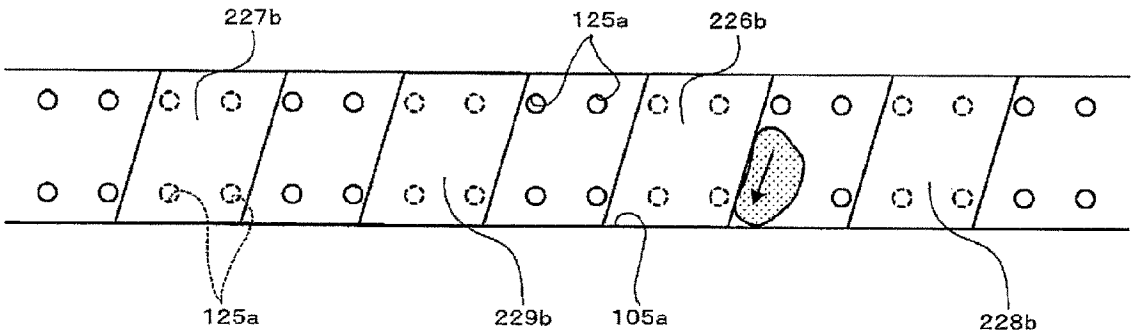
FIGS. 9A to 9C show modification examples.
Figure 9B:
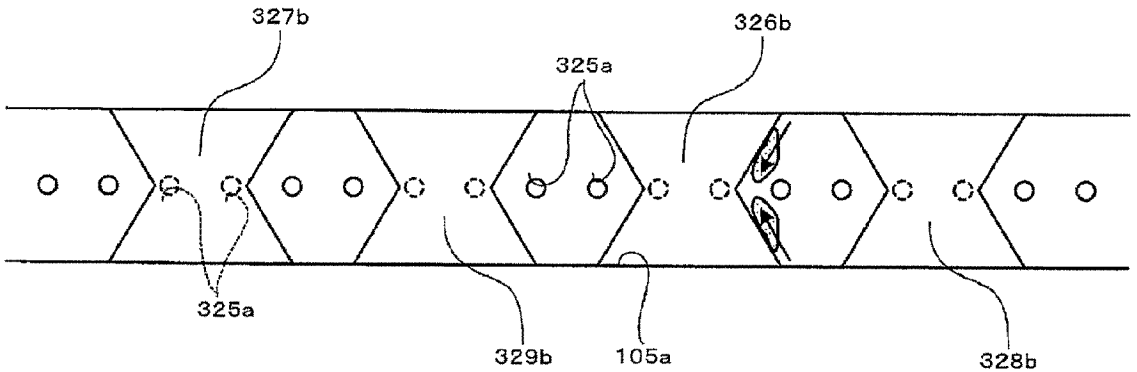
Figure 9C:
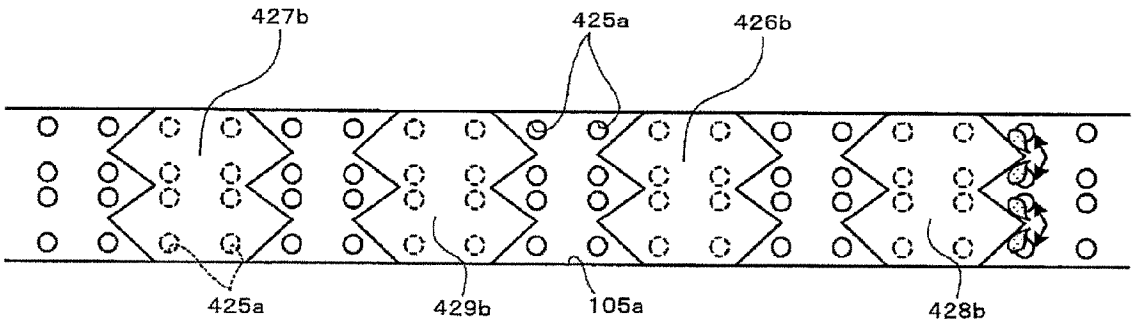

Referring to FIGS. 9A to 9C, modification examples of the present invention will be described. In the above-described embodiment, the side edges of each of the support portions 126*b*, 127*b*, 128*b*, and 129*b* may project outward in the extending direction, in the middle in the width direction, as viewed in the stacking direction. However, the shape of the support portions 126*b*, 127*b*, 128*b*, and 129*b* is not limited to such a shape. For example, in the modification example shown in FIG. 9A, support portions 226*b*, 227*b*, 228*b*, and 229*b* each may include connection portions at both ends, and the support portions 226*b*, 227*b*, 228*b*, and 229*b* each may be connected to the side walls of the sub-manifold channel 105*a* at the connection portions. The connection portions positioned at one end may be positioned on the upper stream side in the flow direction than the connection portions positioned at the other end. More specifically, the side edges of the support portions 226*b*, 227*b*, 228*b*, and 229*b* transverse the extending direction (i.e., ink-flow direction), as viewed in the stacking direction, may be inclined to the ink-flow direction (i.e., extending direction) and may extend parallel to each other. That is, the support portions 226*b*, 227*b*, 228*b*, and 229*b* may have a parallelogram shape. Accordingly, as viewed in the stacking direction, each support portions 226*b*, 227*b*, 228*b*, and 229*b* may have a point-symmetrical shape. Because the support portions 226*b*, 227*b*, 228*b*, and 229*b* may have a simple shape, the manifold plates may be easily fabricated.

When ink flows in the sub-manifold channel 105*a* from the right side to the left side in FIG. 9A, the bubbles flowing into the sub-manifold channel 105*a* may move along the side edges of the support portions 226*b*, 227*b*, 228*b*, and 229*b* with which they collided to the side wall of the sub-manifold channel 105*a* on the lower side in FIG. 9A (see the arrow). Thus, the bubbles flowing into the sub-manifold channel 105*a* may move in the ink-flow direction so as to be guided to the supply ports 125*a* (the exits from the sub-manifold channel 105*a*) arranged along the side wall of the sub-manifold channel 105*a* on the lower side in FIG. 9A.

In the modification example shown in FIG. 9B, a plurality of supply ports 325*a* may be arranged in the middle in the width direction. Side edges of each of support portions 326*b*, 327*b*, 328*b*, and 329*b* transverse the extending direction, as viewed in the stacking direction, may be inclined away from the center in the extending direction, from the middle in the width direction to the side walls of the sub-manifold channel 105*a*. At least one of the side edges of each of the support portions 326*b*, 327*b*, 328*b*, and 329*b* may be inclined toward the upstream side of the ink-flow direction. Thus, the side edges of the support portions 326*b*, 327*b*, 328*b*, and 329*b* may be recessed in the extending direction in the middle in the width direction. In this modification example, each support portions 326*b*, 327*b*, 328*b*, and 329*b* may have a line-symmetrical shape with respect to an imaginary line extending in the width direction, as viewed in the stacking direction. The bottoms of the recessed side edges of the support portions 326*b*, 327*b*, 328*b*, and 329*b* may be arranged so as to oppose a region where supply ports 325*a* are provided.

For example, when ink flows in the sub-manifold channel 105*a* from the right side to the left side in FIG. 9B, the bubbles flowing into the sub-manifold channel 105*a* may collide with the side edges of the support portions 326*b*, 327*b*, 328*b*, and 329*b* and may move along the inclined side edges of the support portions 326*b*, 327*b*, 328*b* and 329*b* toward the middle in the width direction (see the arrows). Thus, the bubbles flowing into the sub-manifold channels 105*a* may move in the ink-flow direction so as to be guided to the supply ports 325*a* arranged in the middle in the width direction of the sub-manifold channels 105*a*.

In the modification example shown in FIG. 9C, a plurality of supply ports 425*a* may be arranged near both edges in the width direction. In addition, the supply ports 425*a* may be arranged in a plurality of, e.g., two, rows in the extending direction, in the middle in the width direction. Side edges of each of support portions 426*b*, 427*b*, 428*b* and 429*b* transverse the extending direction, as viewed in the stacking direction, may be each inclined toward the upstream side of the ink-flow direction from the middle in the width direction to the midpoints between the middle and the side walls of the sub-manifold channel 105*a*. The side edges of each of support portions 426*b*, 427*b*, 428*b* and 429*b* may be also inclined toward the downstream side of the flow direction, from the midpoints to the side walls of the sub-manifold channel 105*a*. Thus, the side edges of the support portions 426*b*, 427*b*, 428*b* and 429*b* each may have a plurality of, e.g., two, projections pointing outward in the extending direction, at the midpoints in the width direction. Each support portions 426*b*, 427*b*, 428*b* and 429*b* may have a line-symmetrical shape with respect to an imaginary line extending in the width direction, as viewed in the stacking direction. The recess and projections may be formed at least the side wall on the upstream side of the flow direction.

For example, when ink flows in the sub-manifold channel 105*a* from the right side to the left side in FIG. 9C, the bubbles flowing into the sub-manifold channel 105*a* may collide with the apexes of the projections of the side edges of the support portions 426*b*, 427*b*, 428*b* and 429*b* and may break into small bubbles. The small bubbles may move along the inclined side edges of the support portions 426*b*, 427*b*, 428*b* and 429*b* from the midpoints in the width direction to the middle and to the side walls of the sub-manifold channels 105*a* (see the arrows). As a result, the small bubbles moving toward the side walls of the sub-manifold channel 105*a* may move in the ink-flow direction toward the supply ports 425*a* arranged near both edges in the width direction of the sub-manifold channel 105*a*. The bubbles moving from the midpoints toward the middle in the width direction may be guided to the supply ports 425*a* in the middle portion. Thus, the bubbles may be rapidly discharged from the supply ports 425*a* together with the ink to be discharged.

Although the embodiments have been described above, the present invention is not to be limited thereto. For example, although the support portions 126*b*, 127*b*, 128*b*, 129*b*, 226*b*, 227*b*, 228*b*, 229*b*, 326*b*, 327*b*, 328*b*, 329*b*, 426*b*, 427*b*, 428*b*, and 429*b* may be line-symmetrical in the above-described embodiments, the support portions do not have to be line-symmetrical or point-symmetrical. In particular, when ink flows in the sub-manifold channels in one direction, only at least part of the side edges positioned on the upstream side of the flow direction may be inclined to the flow direction.

In the above-described embodiments, each of the manifold plates 126, 127, 128, and 129 including the support portions 126*b*, 127*b*, 128*b*, and 129*b* and each of the manifold plates 126, 127, 128, 129 including the support portions 126*b*, 127*b*, 128*b*, and 129*b* adjacent to the aforementioned support portions 126*b*, 127*b*, 128*b*, and 129*b* in the extending direction of the sub-manifold channels 105*a* may be stacked with one or two manifold plates 126, 127, 128, 129 interposed therebetween. However, the stacking order of the manifold plates 126 to 129, i.e., the positional relationship of the support portions 126*b*, 127*b*, 128*b*, and 129*b* in the stacking direction, may be arbitrary. Furthermore, the positional relationship of the support portions 126*b*, 127*b*, 128*b*, and 129*b* in the extending direction may also be arbitrary.

Although embodiments have been described in detail herein, the scope of this patent is not limited thereto. It will be appreciated by those of ordinary skill in the relevant art that various modifications may be made without departing from the scope of the invention. Accordingly, the embodiments disclosed herein are exemplary, and are not limiting. It is to be understood that the scope of the invention is to be determined by the claims which follow.

What is claimed is:

1. A liquid-droplet ejection head comprising stacked plates that form therein a common liquid channel and a plurality of individual ink channels extending from exits from the common liquid channel to nozzles via pressure chambers, wherein at least one of the stacked plates comprise:

an island-shaped partial plate surrounded by the common liquid channel and configured to form at least a part of side walls of the common liquid channel, and a support portion that transverse the common liquid channel and configured to support the partial plate; and wherein at least a part of a side edge of the support portion on an upstream side of a flow direction of liquid in the common liquid channel is inclined to the flow direction, as viewed in a direction perpendicular to the stacked plates.

2. The liquid-droplet ejection head according to claim 1, wherein the exits from the common liquid channel are arranged in a direction in which the common liquid channel extends.

3. The liquid-droplet ejection head according to claim 2, wherein the side edge of the support portion on the upstream side comprises a recess whose bottom portion opposes a region where the exits from the common liquid channel are arranged, as viewed in the direction perpendicular to the stacked plates.

4. The liquid-droplet ejection head according to claim 3, wherein the exits from the common liquid channel are arranged in the middle in a width direction of the common liquid channel.

5. The liquid-droplet ejection head according to claim 4, wherein the side edge of the support portion on the upstream side is inclined toward the upstream side of the flow direction, from the middle in the width direction of the common liquid channel to the side walls of the common liquid channel, as viewed in the direction perpendicular to the stacked plates.

6. The liquid-droplet ejection head according to claim 1, wherein at least a part of the side edge of the support portion on the upstream side is projected, as viewed in the direction perpendicular to the stacked plates.

7. The liquid-droplet ejection head according to claim 6, wherein the exits from the common liquid channel are arranged in a direction in which the common liquid channel extends.

8. The liquid-droplet ejection head according to claim 7, wherein an apex of the projected side edge of the support portion on the upstream side opposes a region where the exits are not arranged, as viewed in the direction perpendicular to the stacked plates.

9. The liquid-droplet ejection head according to claim 8, wherein the exits from the common liquid channel are arranged near both edges in a width direction of the common liquid channel.

10. The liquid-droplet ejection head according to claim 9, wherein the side edge of the support portion on the upstream side is inclined toward a downstream side of the flow direction, from the middle in the width direction of the common liquid channel to the side walls of the common liquid channel, as viewed in the direction perpendicular to the stacked plates.

11. The liquid-droplet ejection head according to claim 9, wherein the side edge of the support portion on the upstream side is inclined toward the upstream side of the flow direction, from the middle in a width direction of the common liquid channel to midpoints between the middle and the side walls of the common liquid channel, and is inclined toward the downstream side of the flow direction, from the midpoints to the side walls of the common liquid channel, as viewed in the direction perpendicular to the stacked plates.

12. The liquid-droplet ejection head according to claim 1, wherein the support portion has a line-symmetrical shape as viewed in the direction perpendicular to the stacked plates.

13. The liquid-droplet ejection head according to claims 1, wherein the support portion has a point-symmetrical shape as viewed in the direction perpendicular to the stacked plates.

14. The liquid-droplet ejection head according to claim 1, wherein the support portion has a parallelogram shape as viewed in the direction perpendicular to the stacked plates.

15. The liquid-droplet ejection head according to claim 1, wherein the side edges of the support portions on an upstream side and downstream side of a flow direction of liquid in the common liquid channel are inclined to the flow direction, as viewed in a direction perpendicular to the stacked plates.

16. The liquid-droplet ejection head according to claim 1, wherein the support portions are disposed at positions that are close to both ends of each of the partial plates in the direction in which the sub-manifold channels extend.

17. The liquid-droplet ejection head according to claim 1, wherein the support portions are disposed on both sides of each of the partial plates with respect to the direction in which the partial plates extend.

18. The liquid-droplet ejection head according to claim 1, wherein the stacked plates further comprises:

a first plate that comprises a first partial plate and a first support portion that supports the first partial plate, a second plate that comprises a second partial plate and a second support portion that is adjacent to the first support portion in a direction in which the common liquid channel extends, the second support portion supporting the second partial plate, and at least one plate that is interposed between the first plate and the second plate.

19. An ink jet printer comprising:

a liquid-droplet ejection head comprising stacked plates that form therein a common liquid channel and a plurality of individual ink channels extending from exits from the common liquid channel to nozzles via pressure chambers, a sheet feeding device configured to feed a recording medium, a sheet discharge device configured to discharge the recording medium, and a sheet conveying path extending from the sheet feeding device to the sheet discharge device along which the recording medium is conveyed; and wherein at least one of the stacked plates comprise:

an island-shaped partial plate surrounded by the common liquid channel and configured to form at least a part of side walls of the common liquid channel, and a support portion that transverse the common liquid channel and configured to support the partial plate; and wherein at least a part of a side edge of the support portion on an upstream side of a flow direction of liquid in the common liquid channel is inclined to the flow direction, as viewed in a direction perpendicular to the stacked plates.

* * * * *